US008075263B2

(12) United States Patent
Ahn

(10) Patent No.: US 8,075,263 B2
(45) Date of Patent: Dec. 13, 2011

(54) FAN MOTOR ASSEMBLY AND AIR GUIDE APPARATUS THEREOF

(75) Inventor: Kwang-Woon Ahn, Seoul (KR)

(73) Assignee: LG Electronics Inc., Seoul (KR)

( * ) Notice: Subject to any disclaimer, the term of this patent is extended or adjusted under 35 U.S.C. 154(b) by 1011 days.

(21) Appl. No.: 11/994,917

(22) PCT Filed: Jul. 11, 2006

(86) PCT No.: PCT/KR2006/002709

§ 371 (c)(1),
(2), (4) Date: Jan. 7, 2008

(87) PCT Pub. No.: WO2007/008020

PCT Pub. Date: Jan. 18, 2007

(65) Prior Publication Data

US 2008/0219840 A1 Sep. 11, 2008

(30) Foreign Application Priority Data

Jul. 11, 2005 (KR) ..... 10-2005-0062442

(51) Int. Cl.
*F04D 29/44* (2006.01)

(52) U.S. Cl. ..... 415/206; 415/208.1; 415/208.2; 415/208.3; 415/211.2

(58) Field of Classification Search ..... 415/159, 415/161, 206, 208.1, 208.2, 208.3, 211.2
See application file for complete search history.

(56) References Cited

U.S. PATENT DOCUMENTS

| | | | | | |
|---|---|---|---|---|---|
| 1,622,930 | A * | 3/1927 | Von Karman et al. | ..... | 416/183 |
| 1,771,711 | A * | 7/1930 | Hahn | ..... | 415/148 |
| 4,824,325 | A * | 4/1989 | Bandukwalla | ..... | 417/211 |
| 4,877,370 | A * | 10/1989 | Nakagawa et al. | ..... | 415/148 |
| 5,178,516 | A * | 1/1993 | Nakagawa et al. | ..... | 415/208.3 |
| 5,316,441 | A * | 5/1994 | Osborne | ..... | 415/208.4 |
| 5,516,263 | A * | 5/1996 | Nishida et al. | ..... | 415/208.2 |
| 6,607,353 | B2 * | 8/2003 | Masutani | ..... | 415/161 |
| 2008/0050252 | A1 | 2/2008 | Ahn | | |

FOREIGN PATENT DOCUMENTS

| | | |
|---|---|---|
| JP | 60-233396 | 11/1985 |
| JP | 11-182485 | 7/1999 |
| JP | 2002-138996 | 5/2002 |
| KR | 10-2005-0088601 | 9/2005 |

OTHER PUBLICATIONS

English language Abstract of JP 2002-138996.
English language Abstract of JP 60-233396.
English language Abstract of KR 10-2005-0088601.
English language Abstract of JP 11-182485.

* cited by examiner

*Primary Examiner* — Igor Kershteyn
(74) *Attorney, Agent, or Firm* — KED & Associates LLP

(57) ABSTRACT

An air guide apparatus includes a body installed at a discharge side of a rotary fan for sucking air, a plurality of first vanes arranged at one surface of the body to guide air sucked by the rotary fan toward the outer circumferential surface of the body, and a plurality of second vanes arranged on the other side of the body to guide air which has been guided by the first vanes from the outer circumferential surface of the body toward a central portion, formed in a spiral shape from the central portion of the body toward the outer circumferential surface of the body, and having disconnected portions formed at middle portions thereof.

14 Claims, 5 Drawing Sheets

FAN MOTOR ASSEMBLY AND AIR GUIDE APPARATUS THEREOF

TECHNICAL FIELD

The present invention relates to a fan motor assembly and its air guide apparatus and, more particularly, to a fan motor assembly having vanes with an improved shape for smoothly guiding or inducing air sucked by a rotating fan in a desired direction, and its air guide apparatus.

BACKGROUND ART

In general, a fan motor assembly is commonly used for a vacuum cleaner that sucks to remove debris such as dust by using a suction force generated according to an operation of a driving motor.

The fan motor assembly includes a driving motor, a rotary fan engaged with a rotary shaft of the driving motor, an air guide member mounted between the driving motor and the rotary fan and guiding air toward the driving motor, and a cover that covers the rotary fan and the air guide member.

In a related art fan motor assembly for a vacuum cleaner, when a rotary fan is rotated fast by the driving motor to suck air, dust is collected in a dust collecting chamber, and air which has passed through the dust collecting chamber is exhausted to outside of a case, thereby performing cleaning. In this process, air distributively exhausted to an edge of the rotary fan is sent to the driving motor by a plurality of vanes formed at a guide member, cooling the driving motor, and then exhausted to outside of the case.

In an air guide member 1 of the related art fan motor assembly, as shown in FIG. 1, while sucked air is being guided or induced toward the driving motor (not shown), air has a viscous frictional force over a surface of a return vane 2, a boundary layer 3 is commonly formed on the surface of the return vane 2.

The boundary layer 3 increases a flow resistance of air blown to the driving motor, resulting in that air cannot smoothly guided toward the driving motor. Herein, the velocity of air flow indicated by an arrow becomes slow as it becomes closer to the surface of the return vane 2.

Accordingly, the amount of air guided to the driving motor, namely, the amount of air blown to the driving motor, is considerably reduced, degrading cooling efficiency of the driving motor, and a vacuum cleaner having such a fan motor assembly cannot have a good cleaning performance.

DISCLOSURE OF THE INVENTION

Therefore, an object of the present invention is to provide a fan motor assembly capable of increasing the amount of blowing air by reducing flow resistance of air and enhancing cooling efficiency of a driving motor, and its air guide apparatus.

To achieve these and other advantages and in accordance with the purpose of the present invention, as embodied and broadly described herein, there is provided a fan motor assembly including: a driving motor; a rotary fan engaged with a rotary shaft of the driving motor; an air guide apparatus mounted between the driving motor and the rotary fan, having a plurality of first vanes arranged on one surface thereof and a plurality of second vanes arranged in a spiral shape on the other surface thereof and having disconnected portions at middle portions thereof; and a cover for covering the rotary fan and the air guide apparatus.

The air guide apparatus includes: a body installed at a discharge side of the rotary fan for sucking air; the plurality of first vanes arranged on one surface of the body to guide air which has been sucked by the rotary fan toward an outer circumferential surface of the body; the plurality of second vanes arranged on the other surface of the body to guide air which has been guided by the first vanes from the outer circumferential surface of the body to a central portion of the body, formed in a spiral shape from the central portion toward the outer circumferential surface of the body, and having disconnected portions (separated portions) at middle portions thereof; and sub-vanes formed in a spiral shape from the central portion of the body toward the outer circumferential surface of the body to guide air which has been guided by the first vanes from the outer circumferential surface toward the central portion of the body, and arranged to be adjacent to the disconnected portions at certain intervals (gap) from the second vanes.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

MODES FOR CARRYING OUT THE PREFERRED EMBODIMENTS

A fan motor assembly and its air guide apparatus according to the present invention will be described with reference to the accompanying drawings.

Figure 2:
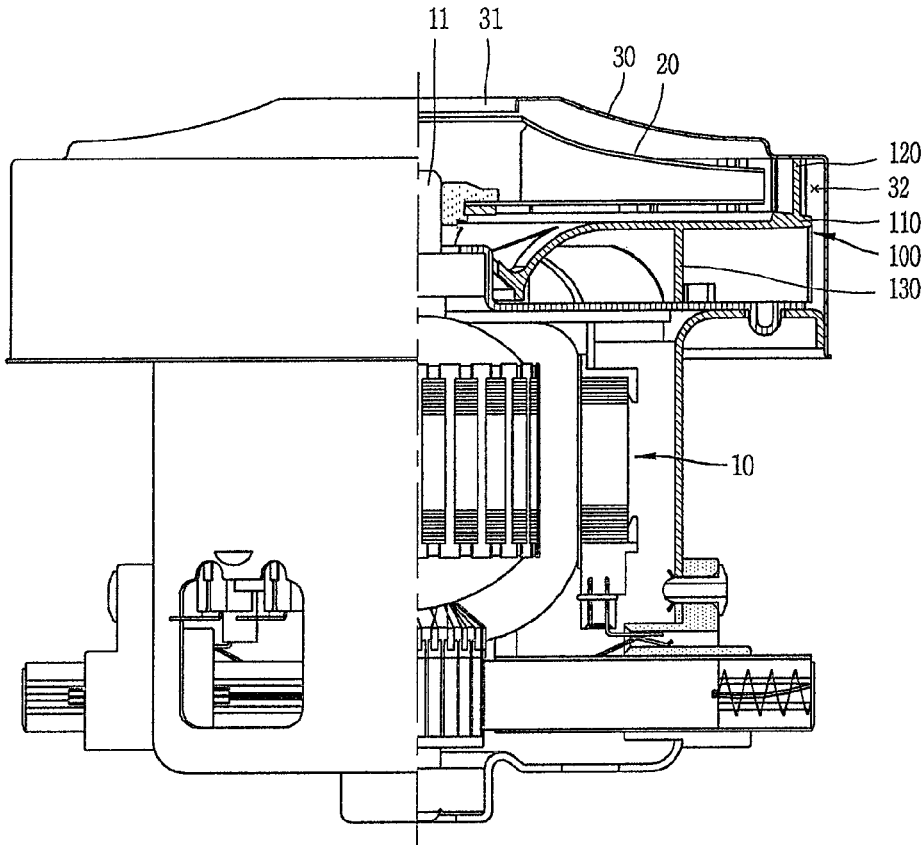
FIG. 2 is a vertical-sectional view showing a fan motor assembly according to one exemplary embodiment of the present invention.

FIG. 2 is a vertical-sectional view showing a fan motor assembly according to one exemplary embodiment of the present invention.

As shown in FIG. 2, a fan motor assembly according to one exemplary embodiment of the present invention includes: a driving motor 10, a rotary fan 20 engaged with a rotary shaft 11 of the driving motor 10, an air guide apparatus 100 mounted between the driving motor 10 and the rotary fan 20 and having a plurality of first vanes 120 arranged on one surface of a body 110 and a plurality of second vanes 130 arranged in a spiral shape on the other side of the first vanes 120 and having disconnected portions 131 (refer to FIG. 2) at the middle portions thereof, and a cover 30 for covering the rotary fan 20 and the air guide apparatus 100.

A suction opening 31 allowing air to pass therethrough is formed on an upper surface of the cover 30. The first vanes 120 is formed on an upper circumferential surface of the body 110, converts dynamic pressure of air into static pressure, and guides air to the second vanes 130.

The second vanes 130 guide and induce air sucked by the first vanes 120 toward the driving motor 10.

The construction of the air guide apparatus according to the present invention will now be described in detail as follows.

Figure 3:
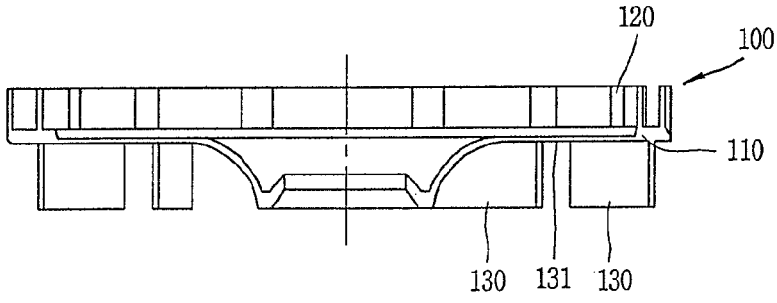
FIG. 3 is a front view showing an air guide apparatus according to one exemplary embodiment of the present invention.
Figure 4:
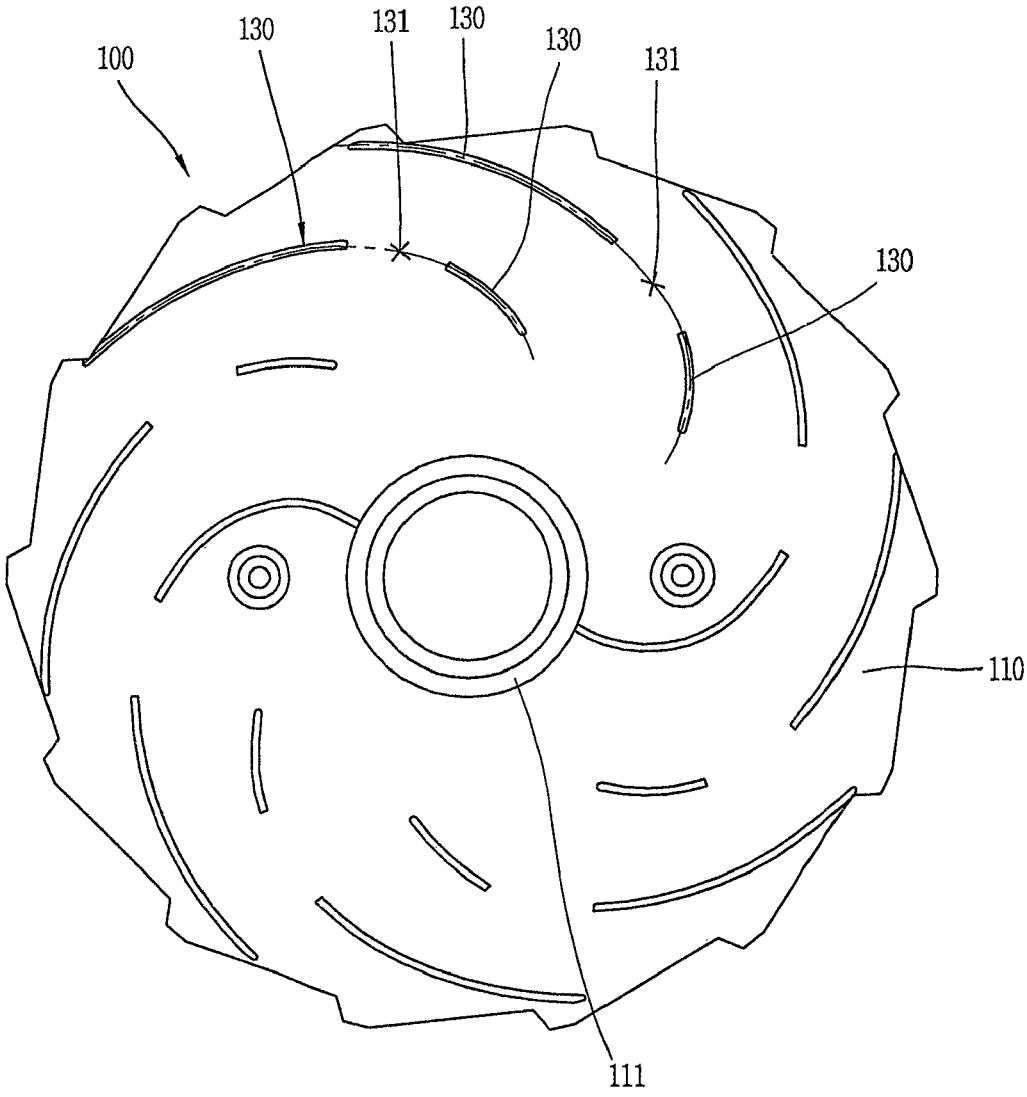
FIG. 4 is a bottom view of FIG. 3.

FIG. 3 is a front view showing an air guide apparatus according to one exemplary embodiment of the present invention and FIG. 4 is a bottom view of FIG. 3.

As shown, the air guide apparatus 100 according to one exemplary embodiment of the present invention includes the body 110 installed at a discharge side of the rotary fan 20 (refer to FIG. 2) for sucking air, a plurality of first vanes 120 arranged at one surface of the body 110 to guide air sucked by the rotary fan 20 toward the outer circumferential surface of the body 110, and the plurality of second vanes 130 arranged on the other side of the body 110 to guide air which has been guided by the first vanes 120 from the outer circumferential surface of the body 110 toward a central portion 111, formed in a spiral shape from the central portion 111 of the body 110 toward the outer circumferential surface of the body 110, and having disconnected portions (or separated portions) 131 formed at middle portions thereof.

In the air guide apparatus 100 according to the present exemplary embodiment of the present invention, with reference to FIGS. 2 and 4, when the driving motor 10 is driven to rotate the rotary fan 20, air is sucked into the cover 30 through the suction opening 31 according to the rotation of the rotary fan 20.

At this time, the sucked air is guided from the outer circumferential surface of the body 110 toward the central portion 111 by the first vanes 120 called diffuser vanes and then sent to the second vanes 130 called return vanes through a space portion 32 of the cover 30.

Air which has been sent to the second vanes 130 is guided to the second vanes 130 and then blown toward the driving motor 10.

As afore-mentioned, the second vanes 130 are formed bent from the central portion 111 of the body 110 toward the outer circumferential surface of the body 110, namely, in the spiral shape, so as to guide air which has been guided by the first vanes 120 toward the central portion 111 of the body 110.

Figure 1:
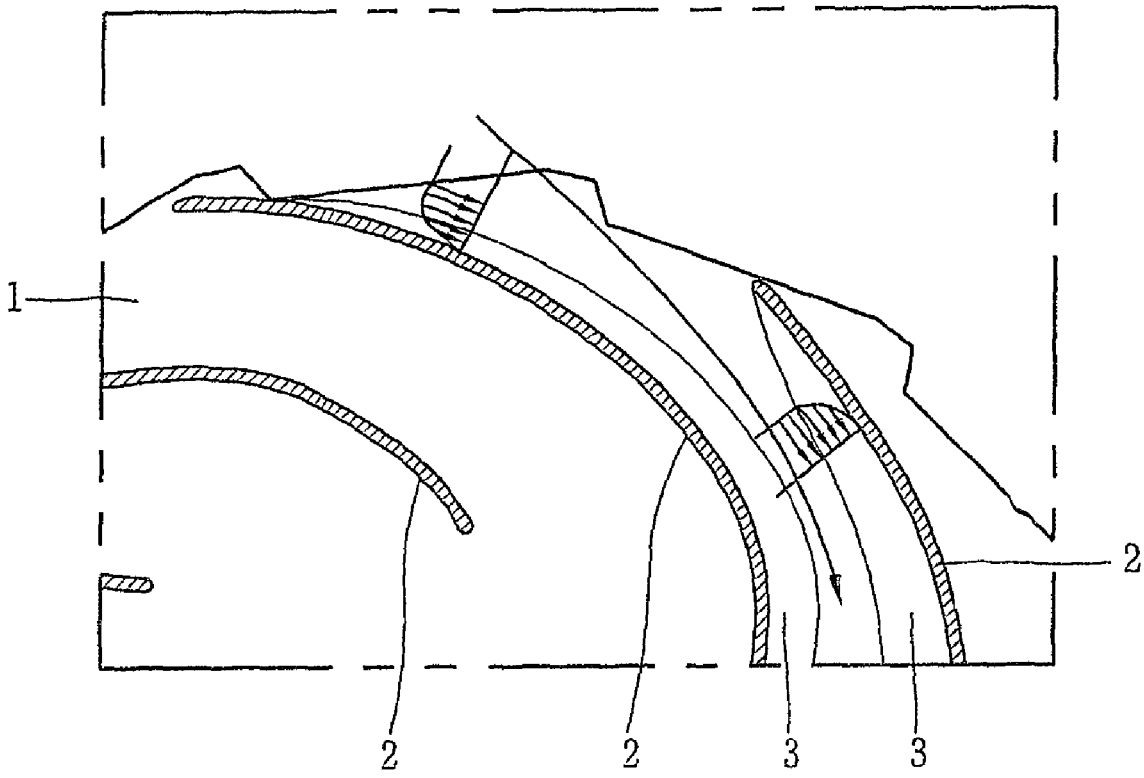
FIG. 1 is a view showing an air flow resistance by a viscous frictional force of air.

In the present exemplary embodiment of the present invention, the air guide apparatus 100 has such characteristics that the second vanes 130 are not continued but disconnected at some certain portions, i.e., at the middle portions, namely, the disconnected portions 131. With the disconnected portions 131 at the middle portions of the second vanes 130, a boundary layer 3 (refer to FIG. 1) according to viscous frictional force of air can be formed to its minimum level, so a flow resistance of air can be considerably reduced. Although not shown, several disconnected portions 131 can be formed at the middle portions of the second vanes 130.

Figure 5:
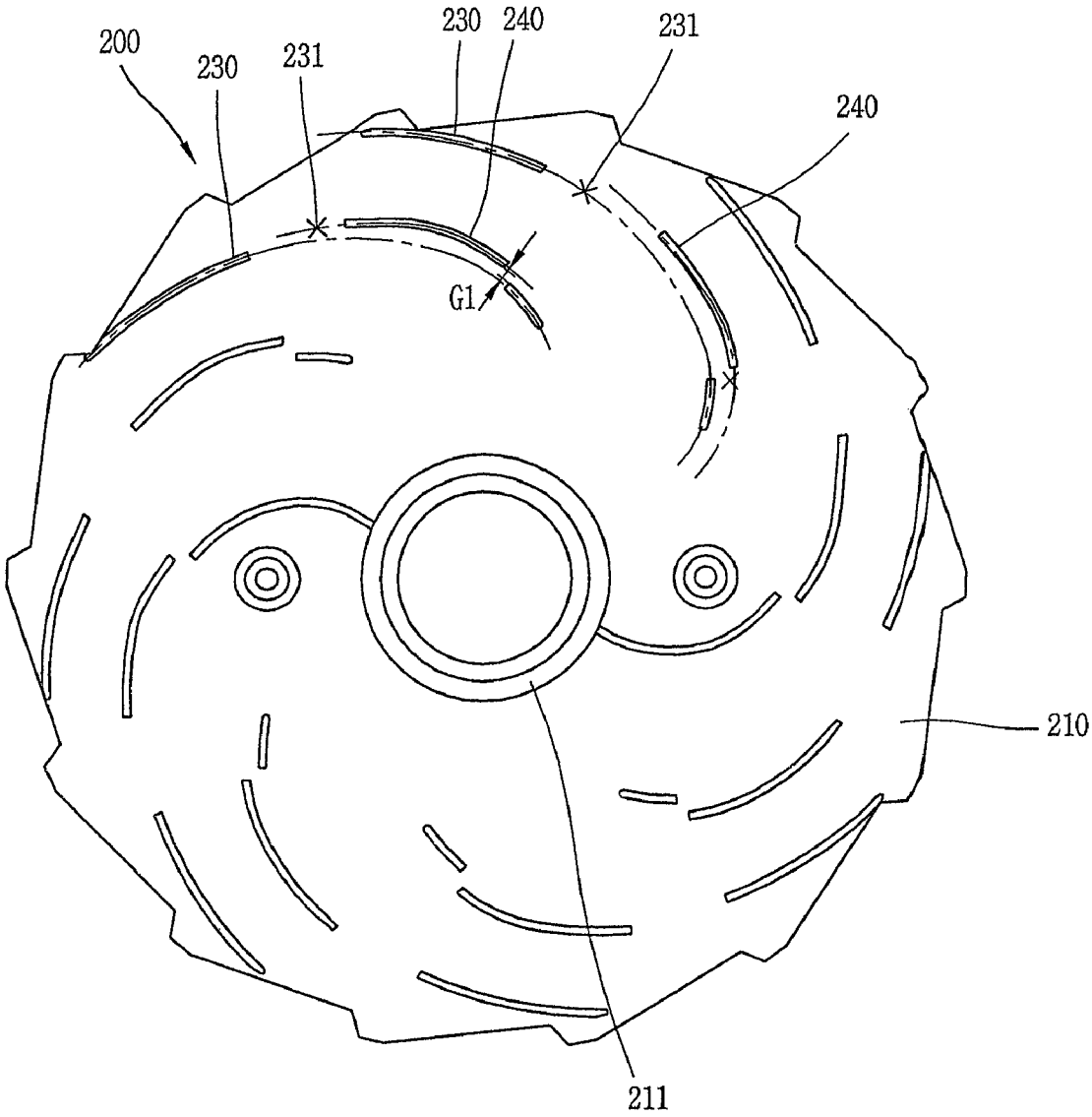
FIG. 5 is a bottom view showing an air guide apparatus according to another exemplary embodiment of the present invention.

FIG. 5 is a bottom view showing an air guide apparatus according to another exemplary embodiment of the present invention.

As shown in FIG. 5, an air guide apparatus 200 according to another exemplary embodiment of the present invention includes: a body 210 installed at a discharge side of the rotary fan 20 for sucking air, a plurality of first vanes 220 arranged at one surface of the body 210 to guide air sucked by the rotary fan 20 toward the outer circumferential surface of the body 210, a plurality of second vanes 230 arranged on the other side of the body 210 to guide air which has been guided by the first vanes 220 from the outer circumferential surface of the body 210 toward a central portion 211, formed in a spiral shape from the central portion 211 of the body 210 toward the outer circumferential surface of the body 210, and having disconnected portions (or separated portions) 231 formed at middle portions thereof, and sub-vanes 240 formed in a spiral shape from the central portion 211 of the body 210 toward the outer circumferential surface of the body 210 in order to guide air which has been guided by the first vanes 220 from the outer circumferential surface of the body 210 toward the central portion 211 of the body 210, and arranged to be adjacent to the disconnected portions 231 at a certain interval (gap) from the second vanes 230.

In the present exemplary embodiment, the air guide apparatus 200 has such characteristics that the sub-vanes 240 are arranged to be adjacent to the disconnected portions 231 to cover the disconnected portions 231 of the second vanes. Herein, the sub-vanes 240 are arranged such that both end portions of the sub-vanes 240 do not overlap with an end portion of the second vanes 230 with a certain gap (G1) therebetween. Accordingly, the amount of air leaked through the disconnected portions 231 can be minimized by the sub-vanes 240 and a flow resistance of air can be considerably reduced.

Figure 6:
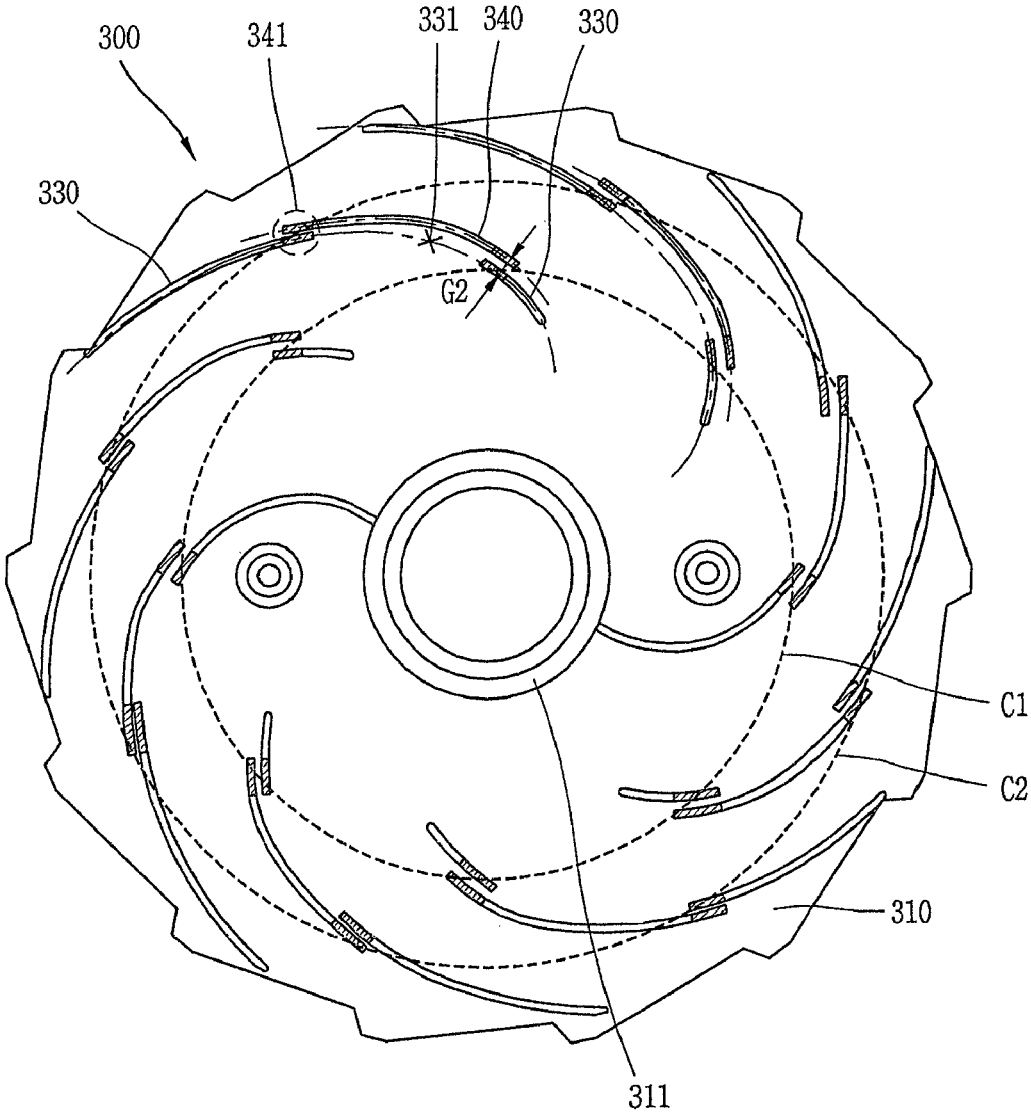
FIG. 6 is a bottom view showing an air guide apparatus according to still another exemplary embodiment of the present invention.

FIG. 6 is a bottom view showing an air guide apparatus according to still another exemplary embodiment of the present invention.

As shown in FIG. 6, an air guide apparatus 300 according to still another exemplary embodiment of the present invention includes: a body 310 installed at a discharge side of the rotary fan 20 for sucking air, a plurality of first vanes 320 arranged at one surface of the body 310 to guide air sucked by the rotary fan 20 toward the outer circumferential surface of the body 310, a plurality of second vanes 330 arranged on the other side of the body 310 to guide air which has been guided by the first vanes 320 from the outer circumferential surface of the body 310 toward a central portion 311, formed in a spiral shape from the central portion 311 of the body 310 toward the outer circumferential surface of the body 310, and having disconnected portions (or separated portions) 331 formed at middle portions thereof, and sub-vanes 340 formed in a spiral shape from the central portion 311 of the body 310 toward the outer circumferential surface of the body 310 in order to guide air which has been guided by the first vanes 320 from the outer circumferential surface of the body 310 toward the central portion 311 of the body 310, and arranged to be adjacent to the disconnected portions 331 at a certain interval (gap) from the second vanes 330.

Herein the sub-vanes 340 are arranged such that both end portions of the sub-vanes 340 overlap with one end portion of the second vanes 330 with a certain gap (G2) therebetween.

Preferably, overlap portions 341 of the both end portions of the sub-vanes 340 and the end portion of the second vanes 330 are arranged at uniform intervals at the circumference of virtual circles C1 and C2 concentrical with the central portion 311 of the body 310 in order to smoothly guide air.

Because the both end portions of the sub-vanes 340 overlap with one end portion of the second vanes 330 with the certain gap (G2), the amount of air leaked through the disconnection portions 331 can be further minimized by the sub-vanes 340, and thus, a flow resistance of air can be considerably reduced.

Preferably, the second vanes 130, 230 and 330 as shown in FIGS. 3 to 6 are integrally formed with the bodies 110, 210 and 310 by injection molding in terms of strength and a fabrication cost, but according to designing conditions, the second vanes 130, 230 and 330 can be separately fabricated and attached or fixed to the bodies 110, 210 and 310 by a general bonding unit or a fixing unit.

The fan motor assembly can be generally used for a vacuum cleaner, but it can be also applicable to other products that require air sucking.

An operation of the fan motor assembly according to a preferred embodiment of the present invention will be described with reference to the accompanying drawings.

To begin with, when the driving motor 10 is driven to rotate the rotary fan 20, air is sucked into the cover 30 through the suction opening 31 of the cover 30 according to the rotation of the rotary fan 20.

The sucked air is guided by the first vanes 120, called diffuser vanes, toward the central portion 111 from the outer circumferential surface of the body 110 and then sent to the second vanes 130, called return vanes, through the space portion 32 (refer to FIG. 2) of the cover 30.

And then, the air which has been sent to the second vanes 130 is guided by the second vanes 130 so as to blow toward the driving motor 10. In this case, because the disconnected portions 131 are formed at the middle portions of the second vanes 130, a viscous frictional force of air can be minimized at the middle portion of the second vanes 130. Thus, the flow resistance of air can be reduced and more amount of air can be guided by the second vanes 130 toward the driving motor 10 to increase cooling efficiency of the driving motor 10.

As so far described, the air guide apparatus according to the present invention has the advantages that because the disconnected portions are formed at the middle portions of the second vanes or the sub-vanes are arranged to be adjacent to the disconnected portions, the viscous frictional force of air can be reduced to reduce the flow resistance of air, and thus, the amount of blowing air can be increased and the cooling efficiency of the driving motor can be considerably enhanced.

In addition, a product including the fan motor of the present invention can have good air suction force and its driving motor could have good cooling efficiency, so its cooling efficiency can be enhanced and its operation can be smoothly performed.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

The invention claimed is:

1. An air guide apparatus, comprising:

a body installed at a discharge side of a rotary fan that sucks air;

a plurality of first vanes arranged at one surface of the body that guides the air sucked by the rotary fan toward an outer circumferential surface of the body;

a plurality of second vanes arranged on another surface of the body that guides the air, which has been guided by the plurality of first vanes, from the outer circumferential surface of the body toward a central portion, formed in a spiral shape from the central portion of the body toward the outer circumferential surface of the body, and having disconnected portions formed at middle portions thereof; and a plurality of sub-vanes formed in a spiral shape from the central portion of the body toward the outer circumferential surface of the body that guides the air, which has been guided by the plurality of first vanes, from the outer circumferential surface of the body toward the central portion of the body, and arranged adjacent to the disconnected portions of the plurality of second vanes at a predetermined gap from the plurality of second vanes, wherein the plurality of second vanes and the plurality of sub-vanes are formed having a same spiral shape curvature, wherein the plurality of sub-vanes are located on a line of parallel translation from a line of the plurality of second vanes, and wherein the plurality of second vanes and the plurality of sub-vanes form a party wall of a passage in which the sucked air flows.

2. The apparatus of claim 1, wherein the plurality of sub-vanes is arranged such that both end portions of the plurality of sub-vanes do not overlap with end portions of the plurality of second vanes by a predetermined gap.

3. The apparatus of claim 1, wherein the plurality of sub-vanes is arranged such that both end portions of the plurality of sub-vanes overlap with respective end portions of the plurality of second vanes by a predetermined gap.

4. The apparatus of claim 3, wherein the plurality of sub-vanes is arranged adjacent to the disconnected portions of the plurality of second vanes to cover the disconnected portions of the plurality of second vanes.

5. The apparatus of claim 1, wherein the plurality of second vanes is integrally formed with the body.

6. The apparatus of claim 1, wherein the plurality of second vanes is separately fabricated and then fixed to the body.

7. The air guide apparatus of claim 1, wherein the disconnected portions formed at middle portions of the plurality of second vanes and the plurality of sub-vanes arranged adjacent to the disconnected portions reduce a flow resistance of the air guided by the plurality of second vanes.

8. An air guide apparatus, comprising:

a body installed at a discharge side of a rotary fan that sucks air; and a plurality of vanes formed at the body that guides the air, which has been sucked by the rotary fan, toward an outer circumferential surface and a central portion of the body, wherein the plurality of vanes is protrusively formed in a spiral shape from the central portion of the body toward the outer circumferential surface of the body and is formed so as not to be continuous but includes disconnected portions, wherein a plurality of sub-vanes is arranged adjacent to the disconnected portions of the plurality of vanes that covers the disconnected portions of the plurality of vanes, wherein the plurality of vanes and the plurality of sub-vanes are formed having a same spiral shape curvature, wherein the plurality of sub-vanes is located on a line of parallel translation from a line of the plurality of vanes, and wherein the plurality of vanes and the plurality of sub-vanes form a party wall of a passage in which the sucked air flows.

9. The apparatus of claim 8, wherein the disconnected portions of the plurality of vanes reduce a flow resistance of the air guided by the plurality of vanes.

10. The apparatus of claim 8, wherein a virtual circular arc formed by the plurality of vanes and a virtual circular arc formed by the plurality of sub-vales are not positioned on a same line.

11. The air guide apparatus of claim 8, wherein the disconnected portions of the plurality of vanes and the plurality of sub-vanes arranged adjacent to the disconnected portions reduce a flow resistance of the air guided by the plurality of vanes.

12. A fan motor assembly, comprising:

a drive motor;

a rotary fan engaged with a rotary shaft of the drive motor;

an air guide apparatus mounted between the drive motor and the rotary fan, the air guiding apparatus having a plurality of first vanes arranged on one surface thereof and a plurality of second vanes arranged in a spiral shape on another surface thereof, wherein the plurality of second vanes includes disconnected portions at middle portions thereof, wherein a plurality of sub-vanes is formed in a spiral shape from a central portion of the air guide apparatus toward an outer circumferential surface of the air guide apparatus that guides air, which has been guided by the plurality of first vanes, from the outer circumferential surface toward the central portion of the air guide apparatus, and wherein the plurality of sub-vanes is arranged adjacent to the disconnected portions at a predetermined gap from the plurality of second vanes; and a cover that covers the rotary fan and the air guide apparatus, wherein the plurality of second vanes and the plurality of sub-vanes are formed having a same spiral shape curvature, wherein the plurality of sub-vanes is located on a line of parallel translation from a line of the plurality of second vanes, and wherein the plurality of second vanes and the plurality of sub-vanes form a party wall of a passage in which sucked air flows.

13. The assembly of claim 12, wherein the air guide apparatus comprises:

a body installed at a discharge side of the rotary fan that sucks the air;

the plurality of first vanes arranged on one surface of the body that guides the air sucked by the rotary fan toward an outer circumferential surface of the body; and the plurality of second vanes arranged on the other surface of the body that guides the air, which has been guided by the plurality of first vanes, from the outer circumferential surface of the body to a central portion of the body, wherein the plurality of second vanes is formed in a spiral shape from the central portion of the body toward the outer circumferential surface of the body, and wherein the plurality of second vanes includes disconnected portions at middle portions thereof.

14. The fan motor assembly of claim 12, wherein the disconnected portions formed at middle portions of the plurality of second vanes and the plurality of sub-vanes arranged adjacent to the disconnected portions reduce a flow resistance of the air guided by the plurality of second vanes.

* * * * *